US008220296B2

(12) United States Patent
Boonstra et al.

(10) Patent No.: US 8,220,296 B2
(45) Date of Patent: Jul. 17, 2012

(54) LOCKING ASSEMBLY HASP

(75) Inventors: Randall Boonstra, Fulton, IL (US); John Benson, Sterling, IL (US)

(73) Assignee: Fenix Manufacturing, Fulton, IL (US)

( * ) Notice: Subject to any disclaimer, the term of this patent is extended or adjusted under 35 U.S.C. 154(b) by 92 days.

(21) Appl. No.: 12/837,083

(22) Filed: Jul. 15, 2010

(65) Prior Publication Data

US 2012/0011682 A1 Jan. 19, 2012

(51) Int. Cl.
*E05B 65/48* (2006.01)

(52) U.S. Cl. ..... 70/2; 70/54; 70/56; 70/417

(58) Field of Classification Search ..... 70/54–56, 70/417, 2, 6–13, 72, 74, 75
See application file for complete search history.

(56) References Cited

U.S. PATENT DOCUMENTS

| | | | | | |
|---|---|---|---|---|---|
| 160,723 | A * | 3/1875 | Smith | 292/281 |
| 722,344 | A * | 3/1903 | Wirt | 292/281 |
| 3,572,796 | A * | 3/1971 | Willner | 292/281 |
| 4,033,155 | A * | 7/1977 | De Lucia | 70/56 |
| 4,095,828 | A | 6/1978 | East | |
| 4,113,291 | A * | 9/1978 | Cameron | 292/40 |
| 4,194,775 | A * | 3/1980 | Shea | 292/307 R |
| 4,322,102 | A * | 3/1982 | Lindblom | 292/281 |
| 4,535,612 | A * | 8/1985 | Seremet | 70/56 |
| 4,852,920 | A | 8/1989 | DeForrest, Sr. | |
| 4,896,518 | A * | 1/1990 | Appelgren | 70/54 |
| 4,898,008 | A * | 2/1990 | Eberly | 70/56 |
| 4,911,486 | A * | 3/1990 | Anderson | 292/148 |
| 5,154,458 | A * | 10/1992 | Cook et al. | 292/218 |
| 5,172,574 | A * | 12/1992 | Perfetto | 70/56 |
| 5,261,258 | A * | 11/1993 | Bunger | 70/56 |
| 5,303,568 | A * | 4/1994 | Wightman | 70/56 |
| 5,458,383 | A | 10/1995 | Gunn | |
| 6,058,745 | A * | 5/2000 | Sanchez | 70/56 |
| 6,351,975 | B1 | 3/2002 | Valdes | |
| 6,708,532 | B2 * | 3/2004 | Winland | 70/2 |
| 6,719,334 | B1 * | 4/2004 | Curtis | 292/281 |
| 2002/0124603 | A1 * | 9/2002 | Yarborough | 70/56 |

* cited by examiner

*Primary Examiner* — Suzanne Barrett
(74) *Attorney, Agent, or Firm* — Greer, Burns & Crain, Ltd.

(57) ABSTRACT

A locking assembly for securing a first item to a second item includes a staple plate configured for attachment to the first item and having a base plate with a staple projecting from the base plate. A hinge plate is configured for attachment to the second item and a flap is pivotably attached to the hinge plate and includes a channel defined by a pair of opposite sidewalls. The channel has a slot for engaging the staple when the flap is in a closed position.

12 Claims, 7 Drawing Sheets

LOCKING ASSEMBLY HASP

BACKGROUND

The present invention relates generally to locking assemblies, and particularly to a locking assembly hasp used with a padlock that prevents tampering by impairing access to the padlock.

Conventional padlocks are well known in the art and are commonly used in conjunction with a hasp for locking two structures together such as a swinging door or gate to a fixed frame or post. The hasp includes an eye or staple attached to a first, usually fixed structure, and a latch portion with a flap attached to a second, usually moving structure. Both the latch portion and the staple have appropriate openings for attachment to the structure using fasteners such as screws or bolts. When the locking assembly is in a closed position and locked with a padlock, an unauthorized person cannot remove the hasp from the structure because the fasteners are covered by the flap. However, in conventional hasp designs, a shackle of the padlock is exposed to snipping by bolt cutters. In addition, an unauthorized person could attempt to pry the hasp away from the structure using a screwdriver or crowbar.

Many approaches and techniques have been utilized to overcome the shortcomings of conventional hasps. For example, in U.S. Pat. No. 4,095,828, a prior art locking assembly incorporates a "double-S" protective enclosure with a central portion forming a barrel like member. A padlock engages an opening in the barrel member and an opening in a bolt which slides along the face of a door underneath the barrel member. While the shackle of the lock is mostly surrounded by the barrel member, upper and lower portions of the double-S enclosure are easily pried open, providing access to the padlock or the fasteners.

In another locking assembly disclosed in U.S. Pat. No. 4,852,920, a flap includes an attached cover section designed to prevent access to the portion of the flap where the slot is located. While this design provides additional protection, the cover makes it difficult to thread the padlock through the staple. In addition, the lock must remain in a vertical orientation, making it more difficult for an authorized entrant to find the keyway. Furthermore, the cover and flaps can be easily pried open, allowing access to the padlock.

SUMMARY

The present locking assembly hasp addresses the drawbacks of conventional locking assemblies. Specifically, the present locking assembly utilizes a pivoting flap on the latch portion, including a recessed channel defined by an opposite pair of forwardly projecting sidewalls. An important feature is that the flap configuration provides only restricted access to the padlock shackle while also covering the mounting hardware. Another important feature is that the padlock is kept in a horizontal orientation, blocking access to the shackle and making the keyway easily accessible for an authorized user. Yet another feature is that the present locking assembly includes end covers and panels that cooperate with the pivoting flap for preventing access to mounting hardware.

More specifically, a locking assembly for securing a first item to a second item includes a staple plate configured for attachment to the first item and having a base plate with a staple projecting from the base plate. A hinge plate is configured for attachment to the second item, and a flap is movably attached to the hinge plate and includes a channel defined by a pair of opposite sidewalls. The channel has a slot for accommodating the staple when the flap is in a closed position.

Also provided is a locking assembly for securing a first item to a second item and including a staple plate configured for attachment to the first item and having a base plate with a staple projecting from the base plate. A hinge plate is configured for attachment to the second item, and a flap is movably attached to the hinge plate. The flap includes a channel defined by a pair of opposite sidewalls and a wall panel extending from each the sidewall such that each the sidewall and panel defines a wedge-shaped cavity. The channel also has a slot for engaging the staple when the flap is in a closed position. Finally, a generally U-shaped end cover projects from each of the staple plate and the hinge plate for generally enclosing the cavity.

DETAILED DESCRIPTION

Figure 1:
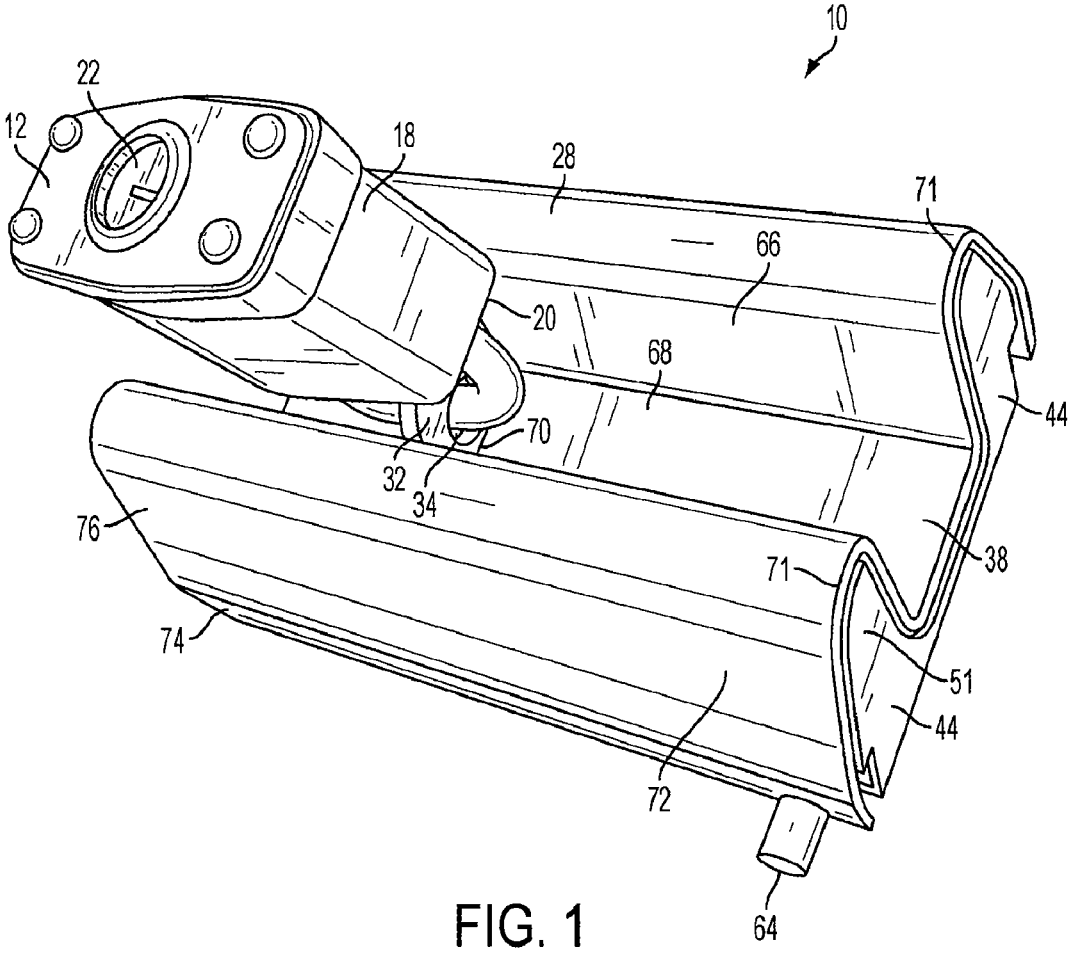
FIG. 1 is a top perspective view of the present locking assembly hasp with a padlock attached.
Figure 2:
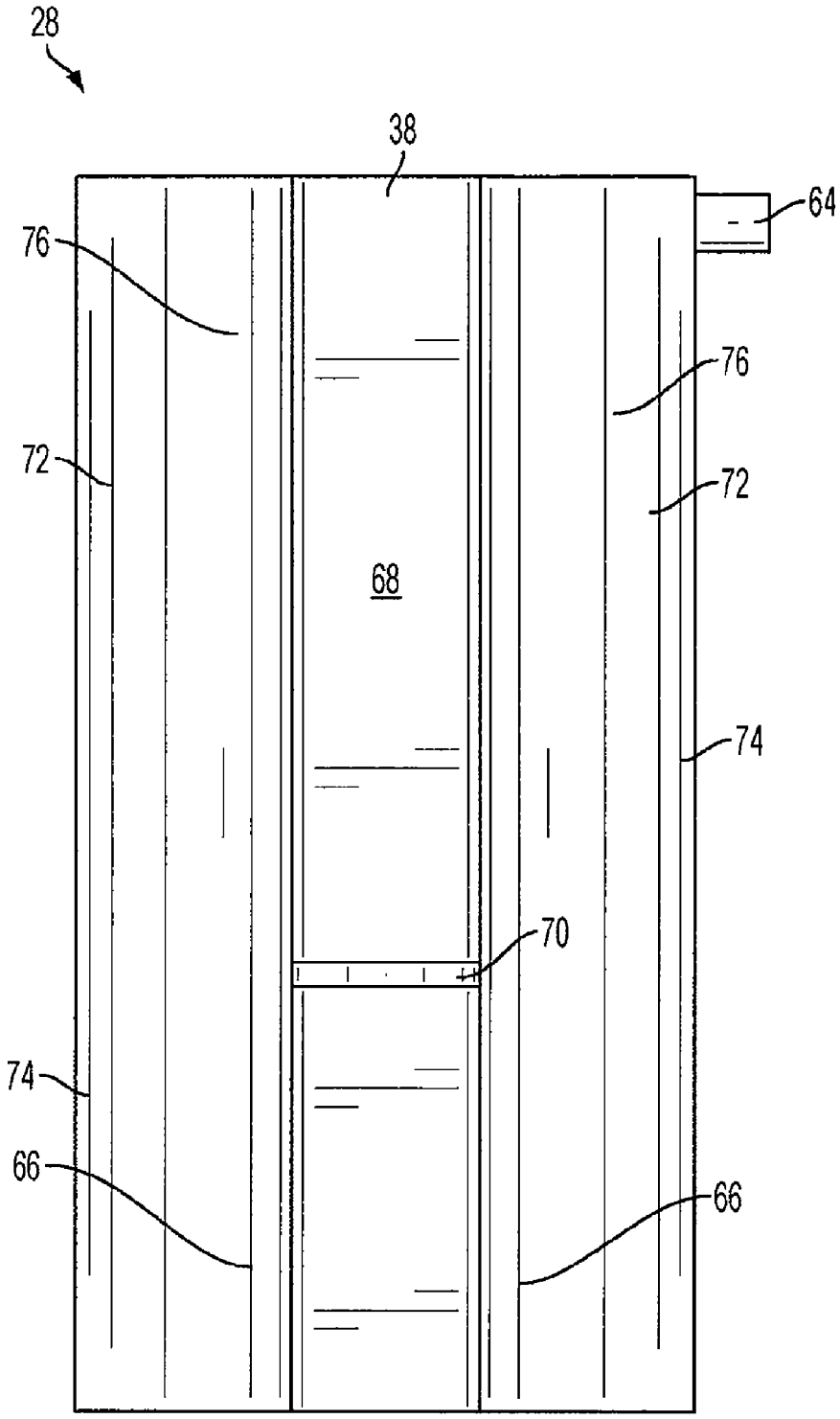
FIG. 2 is a front elevational view of the present locking assembly hasp.
Figure 7:
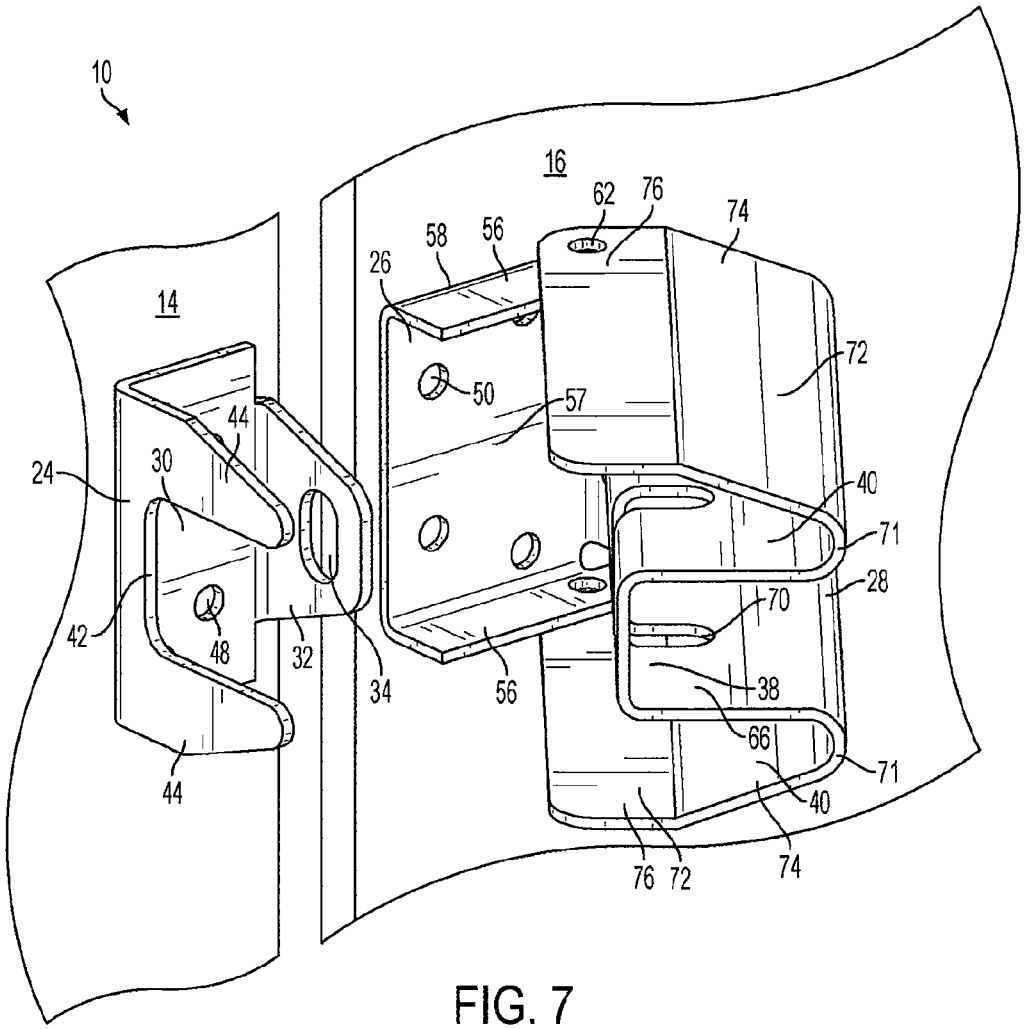
FIG. 7 is a fragmentary perspective view of the present locking assembly hasp in an open position shown mounted to a doorway.

Referring now to FIGS. 1 and 7, a locking assembly incorporating the present invention is generally designated as 10 and is used in conjunction with a padlock 12 for securing a first, typically fixed, item 14 or structure to a second, typically pivoting, item 16. While the preferred first item 14 is a door frame or post, and the second item 16 is a door or gate, it is contemplated that the functions can be reversed. It is also contemplated that the first item 14 and the second item 16 are both movable, such as in a double door or gate configuration. The padlock 12 is a standard padlock as known in the art which includes a body 18 and a generally U-shaped, rod-like shackle 20, and is opened by inserting a key (not shown) into a keyway 22. Combination padlocks are also contemplated as are known in the art.

Figure 3:
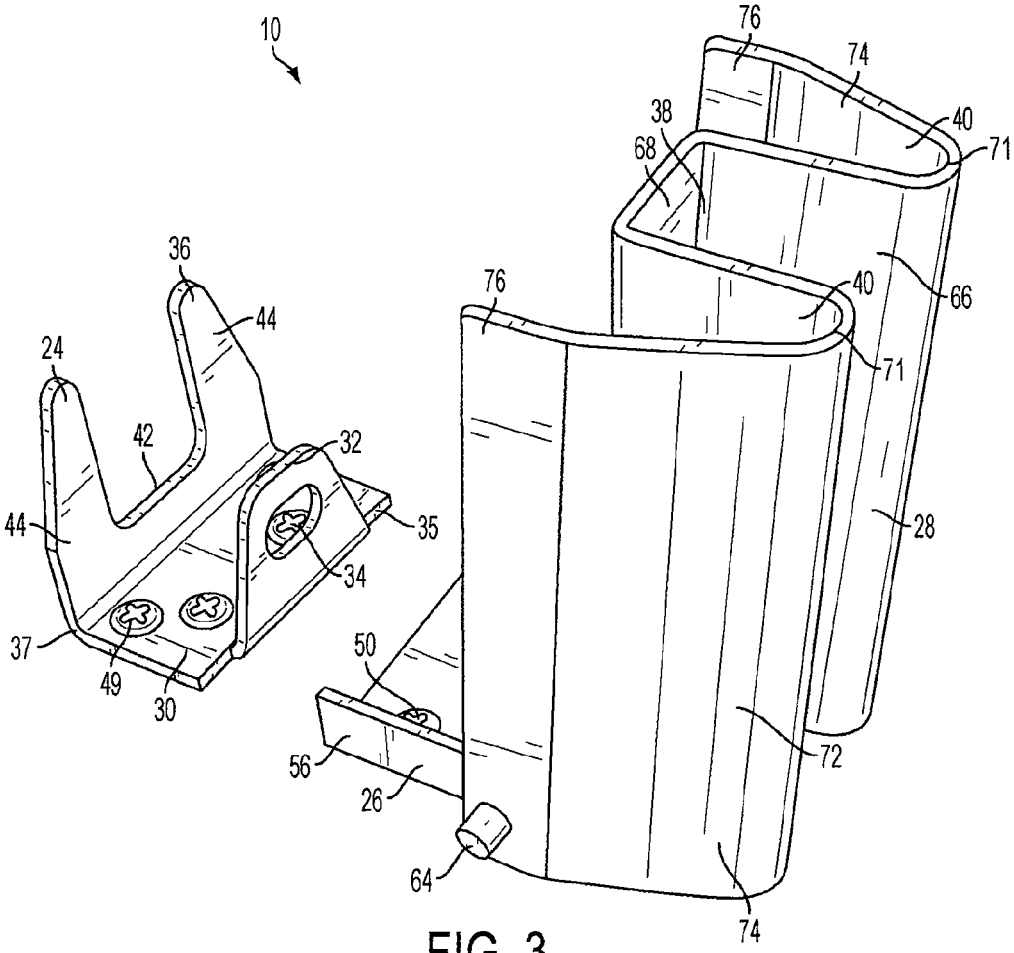
FIG. 3 is a bottom perspective view of the present locking assembly hasp in an open position.

Referring now to FIGS. 1, 3 and 7, the present locking assembly 10 includes a staple plate 24 and a hinge plate 26 with an attached flap 28. Preferably, the staple plate 24, the hinge plate 26, and the flap 28 are made of durable, corrosion resistant metal such as hardened stainless steel or the like. As will be discussed below, the flap 28 pivots between an open position (FIG. 3) and a closed position (FIG. 1).

Figure 5:
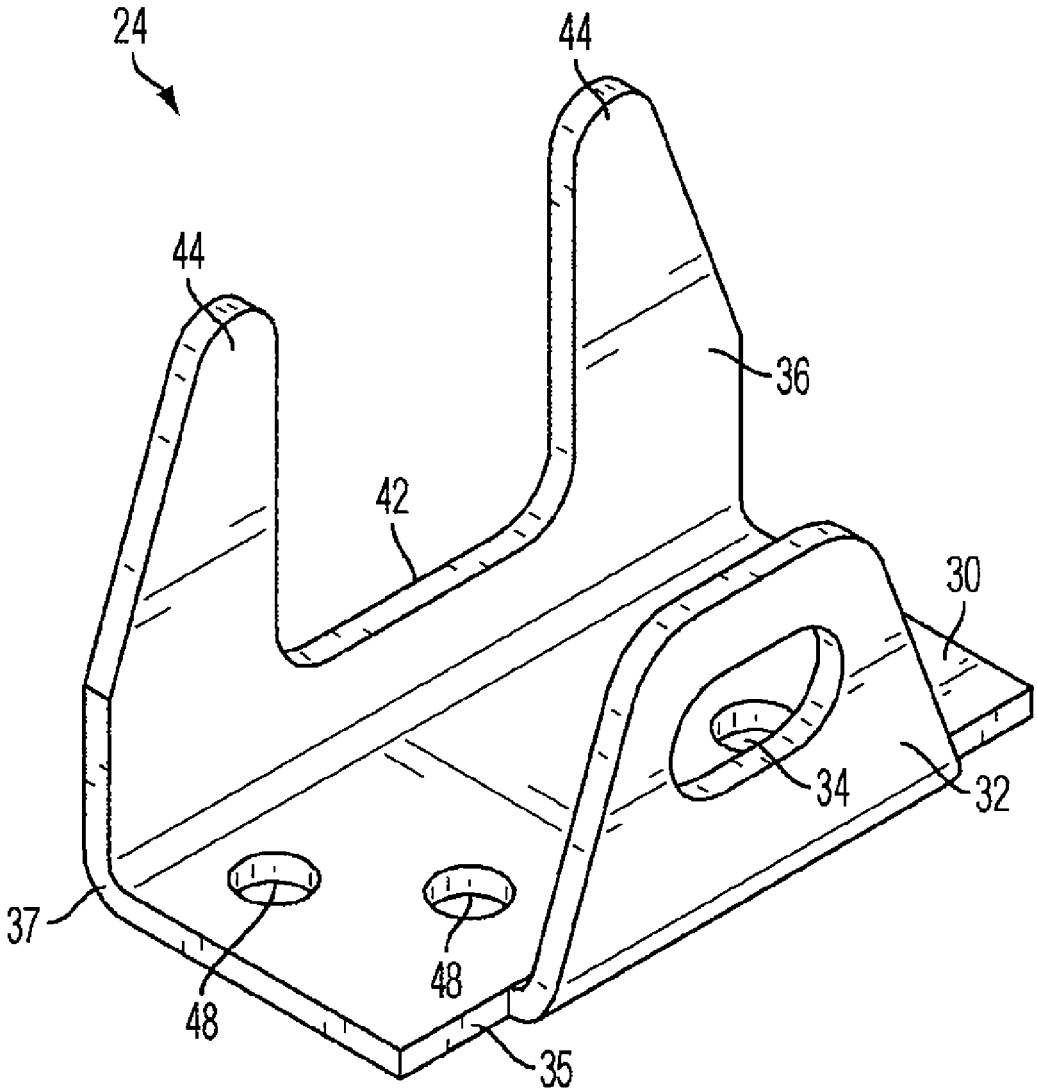
FIG. 5 is a top perspective view of the staple plate included in the present locking assembly hasp.

As best shown in FIGS. 3 and 5, the staple plate 24 has a base plate 30 with a staple 32 projecting from the base plate. The staple 32 preferably projects in a normal orientation relative to the base plate 30 and is generally centrally located on a first edge 35. In addition, the staple 32 includes an aperture or eye 34 for receiving the padlock shackle 20. It is contemplated that the size of the staple 32 and aperture 34 may vary to suit the size of the corresponding padlock shackle 20.

A first end cover 36 is disposed on a second edge 37 of the staple plate 24, and is configured for engaging a channel 38 and a pair of cavities 40 defined by the flap 28. The first end cover 36 projects in a normal orientation relative to the base plate 30, preferably parallel to the staple 32, and includes a generally U-shaped cutout 42 and two prongs 44. Depending on the application, the shape and configuration of the end cover 36 may vary based on the flap 28. Both the end cover 36 and the staple 32 are generally planar and preferably project from the base plate 30 such as by being stamped by a press and formed at an approximate right angle to the base plate as is known in the art.

At least one opening 48 is provided on the base plate 30 (FIG. 5) for attachment to the first item 14 using at least one fastener 49, preferably contemplated to be a threaded fastener such as a screw as known in the art. However, other equivalent fasteners 49 are contemplated. The size and number of the openings 48 may vary to suit the situation and size of the locking assembly 10.

Figure 6:
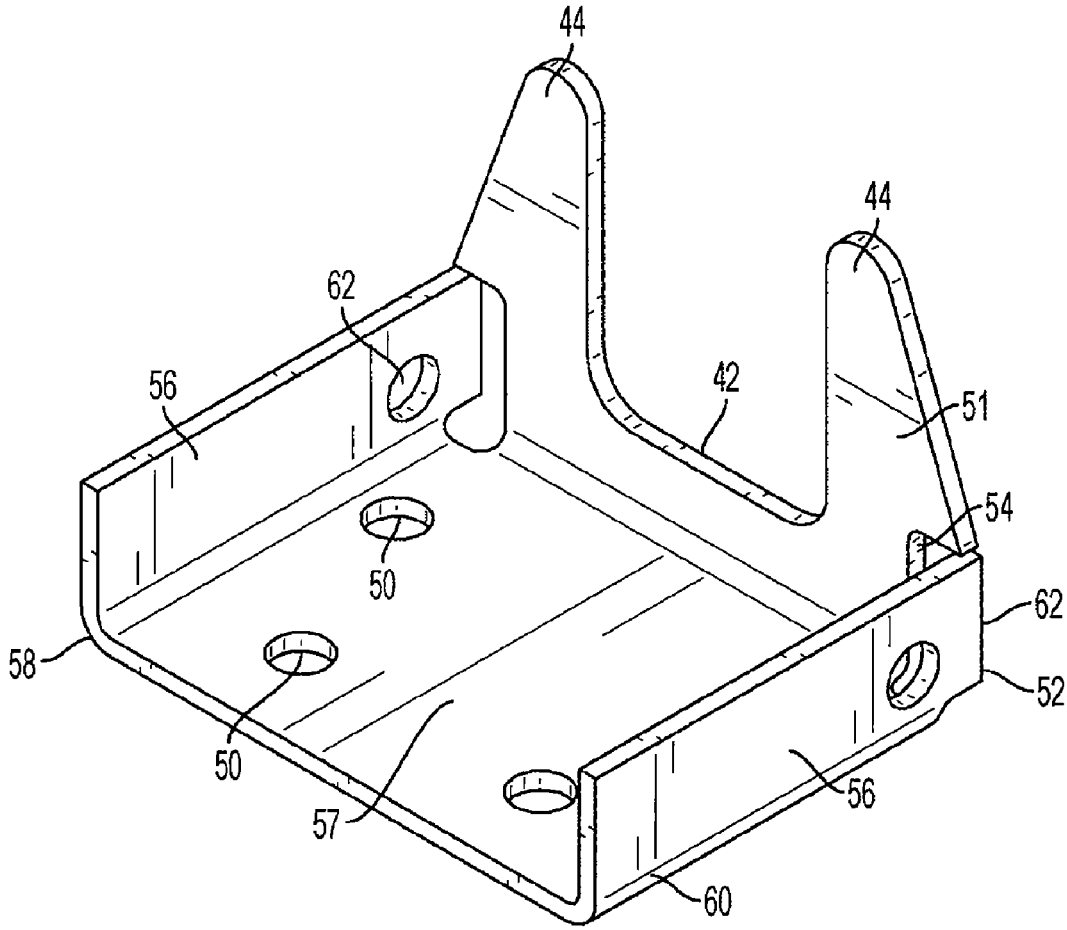
FIG. 6 is a top perspective view of the hinge plate included in the present locking assembly hasp.

Referring now to FIGS. 3 and 6, similar to the staple plate 24, the hinge plate 26 also includes at least one opening 50 for attachment to the second item 16 using at least one fastener 49. Also, the hinge plate 26 preferably has a second end cover 51 positioned on a hinge plate first edge 52, and has the same or similar shape and configuration as the first end cover 36. In addition, the hinge plate 26 has a pair of notches 54 for accommodating a pair of generally planar lip sections 56 normally projecting from a hinge plate base 57. The lip sections 56 are respectively positioned on a third edge 58 and a fourth edge 60 of the hinge plate 26 and extend along the entire length of the corresponding edge. It is preferred that the lip sections 56 and the second end cover 51 project from the hinge plate base 57 such as by being stamped by a press and formed at an approximate right angle as is known in the art.

In the preferred embodiment, each lip section 56 includes an aperture 62 positioned near the first edge 52 and for inserting a pin 64 used to pivotably attach the flap 28. The flap 28 pivotably rotates about the pin 64 towards and away from the staple plate 24 between the closed position as shown in FIG. 1, and the open position as shown in FIGS. 3 and 7. Depending on the diameter of the pin 64, the size of the aperture 62 and the corresponding lip section 56 may vary. Other mechanisms for pivotably attaching the flap 28, such as one or more hinges, are also contemplated. In such a configuration, the lip sections 56 or notches 54 may not be required.

Figure 4:
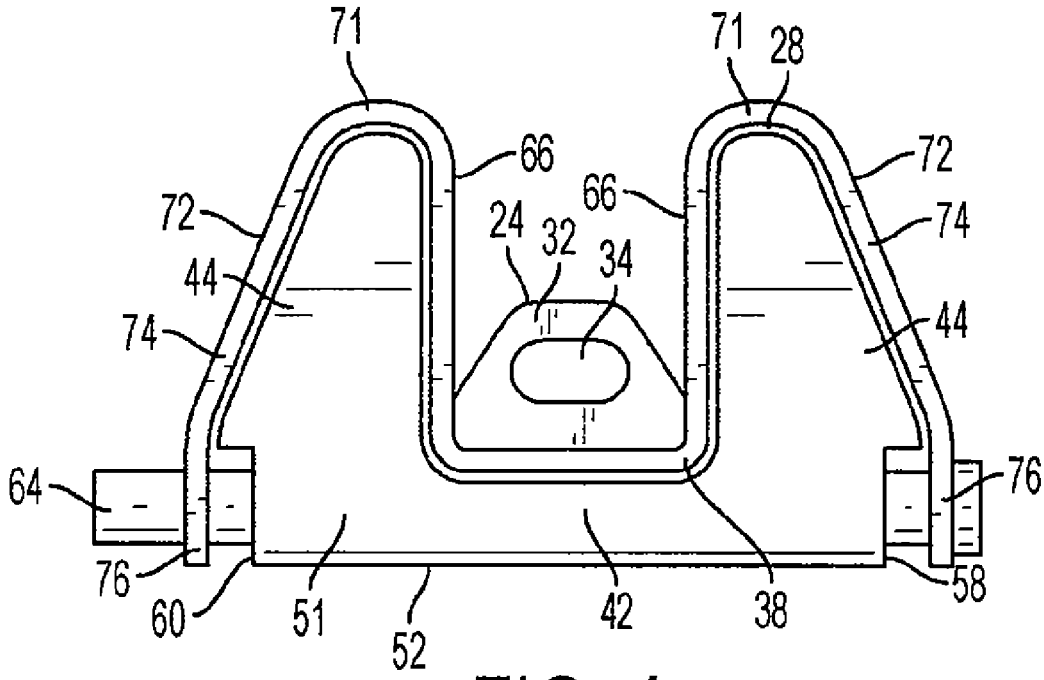
FIG. 4 is a side elevation of the present locking assembly hasp as viewed from the hinge plate end.

As best seen in FIGS. 1 and 4, the channel 38 on the flap 28 is defined by a pair of opposite sidewalls 66 and a flap base 68. The sidewalls 66 project in an essentially perpendicular manner from the flap base 68 to form the generally U-shaped channel 38. In the preferred embodiment, the channel 38 is narrowly dimensioned to correspond with the size of the padlock shackle 20 and staple plate 24. This configuration limits exposure of the shackle 20 to prevent snipping by bolt cutters or other similar devices. In addition, this configuration also protects the staple plate 24 from tampering with bolt cutters or a pry bar.

The channel 38 also includes a slot 70 for accommodating the staple 32 when the flap 28 is in the closed position. The preferred configuration also provides that the flap 28 further includes a pair of wall panels 72 defining a convex or wedge-like profile with each wall panel having a free edge extending in the direction of the first and second items 14, 16. A common edge 71 between the wall panels 72 and the sidewalls 66 is radiused, and each sidewall and panel define the cavities 40. It is preferred that the flap 28 is unitary and stamped and formed from a single sheet of steel.

In addition, each wall panel 72 preferably has an angled main portion 74 and an edge portion 76. The main portion 74 extends in the direction of the first and second items 14, 16 at an acute angle relative to the Z axis and the edge portion 76 extends in a generally perpendicular fashion until contact is made with the first and second items 14, 16 in the closed position. As such, the edge portion 76 is flush against the first and second items 14, 16 in a closed position so that the staple plate 24 and hinge plate 26 are enclosed by the panels 72. The configuration of the sidewalls 66 and panels 72 may vary based on design preference, but generally corresponds with the design of the first and second end covers 36, 51.

Referring now to FIGS. 1 and 7, the staple plate 24 and the hinge plate 26 are respectively positioned on the first and second items 14, 16 so that the slot 70 aligns with the staple 32 when the flap 28 is in the closed position. When in the closed position, the end covers 36, 51 close the cavities 40, and the U-shaped cutout 42 engages the channel 38 as best shown in FIG. 4. As should be appreciated, the U-shaped cutout 42 and prongs 44 limit access to the cavities 40 where the fasteners 49 are located. Limiting access to the cavities 40 also prevents an intruder from positioning a crow bar under the flap 28 and attempting to pry it off.

As best shown in FIG. 1, when the locking assembly 10 is in a closed position, the staple plate 24 and padlock shackle 20 are protected by the forwardly projecting sidewalls 66 to prevent tampering with the lock 12 and staple plate. Protection against prying is provided by the wedge-shape defined by the wall panels 72 and the sidewalls 66. In addition, the end covers 36, 51 and the wall panels 72 define an enclosed space which prevents access to the staple plate 24 or the hinge plate 26 and the fasteners 49. Finally, the channel 38 and the sidewalls 66 also keep the padlock 12 in a generally horizontal orientation so that the keyway 22 is easily accessible.

Once in the closed position, in the event an intruder attempts to or even successfully removes the pin 64, the lock 12 cannot be pried open due to the narrow dimension of the channel 38. Thus, the intruder will find it difficult to remove the flap 28.

In the open position, once the flap 28 is pivoted free (FIG. 3), the user has access to the staple plate 24, and the hinge plate 26, in the event adjustments are needed. In some applications, the open flap 28 is usable to pull open the associated door or gate.

While a particular embodiment of the present locking assembly has been shown and described, it will be appreciated by those skilled in the art that changes and modifications may be made thereto without departing from the invention in its broader aspects and as set forth in the following claims.

What is claimed is:

1. A locking assembly for securing a first item to a second item, comprising:

a staple plate configured for attachment to the first item and having a base plate with a staple projecting from said base plate;

a hinge plate configured for attachment to the second item; and a flap pivotably attached to said hinge plate and including a channel defined by a pair of opposite sidewalls, and a wall panel extending from each said sidewall such that each said sidewall and said panel define a cavity, said channel including a slot for engaging said staple when said flap is in a closed position.

2. The locking assembly of claim 1 wherein said staple plate and said hinge plate each include a corresponding end cover for engaging each said cavity.

3. The locking assembly of claim 1 wherein said flap pivotably attaches to said hinge plate using a pin.

4. The locking assembly of claim 1 wherein said staple includes an eye for receiving a padlock upon said flap reaching said closed position.

5. The locking assembly of claim 1 wherein said staple plate and said hinge plate are positionable on said first and second items so that said slot aligns with said staple when said flap is in the closed position.

6. The locking assembly of claim 1 wherein said staple plate and said hinge plate each include at least one opening for being secured to the first item and second item with a fastener.

7. The locking assembly of claim 1 further comprising a radiused common edge between said panels and sidewalls.

8. The locking assembly of claim 1 wherein said flap is unitary and encloses said staple plate and said hinge plate when in the closed position.

9. The locking assembly of claim 1 wherein said staple projects in a normal orientation relative to said base plate.

10. The locking assembly of claim 3 wherein said flap pivotably rotates in the direction of said staple plate.

11. The locking assembly of claim 1 wherein said channel is narrowly dimensioned to correspond with the size of a padlock shackle.

12. A locking assembly for securing a first item to a second item, comprising:

a staple plate configured for attachment to the first item and having a base plate with a staple projecting from said base plate;

a hinge plate configured for attachment to the second item;

a flap pivotably attached to said hinge plate and including a channel defined by a pair of opposite sidewalls and a wall panel extending from each said sidewall such that each said sidewall and said panel defines a wedge-shaped cavity, said channel including a slot for engaging said staple when said flap is in a closed position; and a generally U-shaped end cover projecting from each of said staple plate and said hinge plate, said end covers configured for generally enclosing each said cavity.

* * * * *